US011645984B2

(12) United States Patent
Wang

(10) Patent No.: US 11,645,984 B2
(45) Date of Patent: May 9, 2023

(54) DISPLAY DEVICE DRIVING METHOD, AND DISPLAY DEVICE

(71) Applicant: HKC CORPORATION LIMITED, Shenzhen (CN)

(72) Inventor: Mingliang Wang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/727,836

(22) Filed: Apr. 25, 2022

(65) Prior Publication Data

US 2022/0246102 A1 Aug. 4, 2022

Related U.S. Application Data

(62) Division of application No. 17/040,043, filed on Sep. 21, 2020, now Pat. No. 11,348,540.

(51) Int. Cl.
*G09G 3/34* (2006.01)

(52) U.S. Cl.
CPC ..... *G09G 3/3413* (2013.01); *G09G 2310/08* (2013.01); *G09G 2330/021* (2013.01)

(58) Field of Classification Search
CPC ..... G09G 3/3413; G09G 2310/08; G09G 2330/021
See application file for complete search history.

(56) References Cited

U.S. PATENT DOCUMENTS

2011/0169796 A1* 7/2011 Guo ..... G09G 3/3677 345/94

FOREIGN PATENT DOCUMENTS

KR 2003040143 A * 5/2003 ..... G09G 3/20

* cited by examiner

*Primary Examiner* — Stephen G Sherman

(57) ABSTRACT

This application discloses a display device driving method and a display device. The driving method includes steps of: synchronously starting a backlight circuit, a timing control circuit and a power circuit; outputting a first signal after the timing control circuit is initialized; outputting a second signal after the power circuit is started; and controlling a gate driver to output a drive signal according to the first signal and the second signal.

3 Claims, 5 Drawing Sheets

DISPLAY DEVICE DRIVING METHOD, AND DISPLAY DEVICE

This application is a Divisional of U.S. patent application Ser. No. 17/040,043 filed on Sep. 21, 2020. This application claims the priority to the Chinese Patent Application No. CN201811337228.4, filed with National Intellectual Property Administration, PRC on Nov. 12, 2018 and entitled "DRIVE CIRCUIT OF DISPLAY PANEL, AND DISPLAY PANEL", and the Chinese Patent Application No. CN201811337237.3, filed with National Intellectual Property Administration, PRC on Nov. 12, 2018 and entitled "DISPLAY PANEL DRIVING METHOD, DISPLAY DEVICE, AND DISPLAY" which are incorporated herein by reference in their entireties.

TECHNICAL FIELD

This application relates to the field of display technologies, and particularly to a display device driving method, and a display device.

BACKGROUND

The description herein provides only background information related to this application, but does not necessarily constitute the existing technology.

With the continuous development of liquid crystal technology, liquid crystal displays have been widely used in the fields such as computers, mobile phones, televisions. Since the liquid crystal display panel itself does not emit light, a backlight module has to be added to the panel. The backlight module is one of the key components of the liquid crystal display, and supplies light having sufficient brightness and distributed uniformly to enable normal display of images. The lighting effect of the backlight module will directly affect the visual effect of the liquid crystal display. When the display device is turned on, each unit is initially configured, which consumes some time. The display panel of the display device can display normally only after each unit completes the initial configuration.

When the display device is just turned on, the internal chip of the display device takes some time to read initial data, and the power supply takes some time to complete the configuration. During this time the backlight module of the display device has been working normally, and the boot screen abnormality is relatively easy to occur.

SUMMARY

This application provides a display device driving method for improving the booting efficiency and a display device.

This application discloses a display device driving method, including steps of:

synchronously starting a backlight circuit, a timing control circuit and a power circuit;

outputting a first signal after the timing control circuit is initialized;

outputting a second signal after the power circuit is started; and controlling a gate driver to output a drive signal according to the first signal and the second signal.

Optionally, the second signal includes a starting voltage signal, and the starting voltage signal is output to a scanning line through the gate driver;

the step of controlling a gate driver to output a drive signal according to the first signal and the second signal includes:

controlling a gate driver to output a drive signal according to the first signal and the starting voltage signal.

Optionally, the step of controlling a gate driver to output a drive signal according to the first signal and the second signal includes: outputting a power starting signal according to the starting voltage signal; and controlling a gate driver to output a drive signal according to the first signal and the power starting signal;

wherein the voltage of the power starting signal is lower than that of the starting voltage signal.

Optionally, the step of outputting a power starting signal according to the starting voltage signal includes: outputting a power starting signal when the voltage of the starting voltage signal reaches 30 V.

Optionally, the step of controlling a gate driver to output a drive signal according to the first signal and the second signal includes: controlling a gate driver to output a drive signal when the first signal changes from a low level to a high level and the second signal satisfies a condition.

This application further discloses a display device, including a backlight circuit and a display panel;

the backlight circuit provides backlight for the display panel;

the display panel includes: a timing control circuit configured to read initial data of the display panel, a power circuit configured to supply power to the display panel, a gate driver configured to drive a scanning line of the display panel, and a control circuit;

the timing control circuit outputs a first signal to the control circuit; the power circuit outputs a second signal to the control circuit; and the control circuit controls the gate driver to output a drive signal according, to the first signal and the second signal.

Optionally, the second signal includes a starting voltage signal, the starting voltage signal is output to the gate driver, and the control circuit controls the gate driver to output a drive signal according to the first signal and the starting voltage signal.

Optionally, the control circuit includes a detection circuit and a gate circuit, wherein the detection circuit reads the starting voltage signal and outputs a power starting signal;

the detection circuit is connected to the power circuit and the gate circuit separately, and the gate circuit is further connected to a timing control chip;

the first signal and the power starting signal are output to the gate circuit, and the gate circuit controls the gate driver to output a drive signal according to the first signal and the starting voltage signal.

Optionally, the gate circuit includes an AND gate circuit, the detection circuit and the timing control circuit are connected to an output end of the AND gate circuit, and the AND gate circuit controls the gate driver to output a drive signal according to the first signal and the starting voltage signal.

Optionally, the control circuit includes:

a buck circuit configured to reduce the voltage of an input signal; and a switch circuit configured to judge an output signal;

the switch circuit includes a first input end and a second input end;

the timing control circuit is connected to the first input end of the switch circuit, the power circuit is connected to the second input end of the switch circuit through the buck circuit, and the output end of the switch circuit is connected to the gate driver.

Optionally, the switch circuit further includes:

a first judgment circuit configured to output a first logic signal according to the signal input by the timing control circuit;

a second judgment circuit configured to output a second logic signal according to the signal input by the buck circuit; and a third judgment circuit configured to output a third logic signal according to the first logic signal and the second logic signal;

wherein the input end of the first judgment circuit is connected to the timing control circuit, the input end of the second judgment circuit is connected to the buck circuit, the output ends of the first judgment circuit and the second judgment circuit are connected to the input end of the third judgment circuit, and the output end of the third judgment circuit is connected to the gate driver.

Optionally, the buck circuit includes a first resistor and a second resistor, the first resistor is connected in series with the second resistor, the first end of the first resistor is connected to the power circuit, the second end of the first resistor is connected to the first end of the second resistor, the second end of the second resistor is grounded, and the second input end of the switch circuit is connected between the first resistor and the second resistor.

Optionally, the resistance of the first resistor is greater than that of the second resistor.

Optionally, the first judgment circuit includes a first active switch, the input end of the first active switch is connected to the timing control circuit, and the output end of the first active switch is connected to the second judgment circuit.

Optionally, the second judgment circuit includes a second active switch, the input end of the second active switch is connected to the buck circuit, and the output end of the second active switch is connected to the second judgment circuit.

Optionally, the third judgment circuit includes a third active switch, the input end of the third active switch is connected to the first judgment circuit and the second judgment circuit separately, and the output end of the third active switch is connected to the gate driver.

Optionally, the first judgment circuit includes a first gate circuit, the second judgment circuit includes a second gate circuit, and the third judgment circuit includes a third gate circuit.

This application further discloses a display device, including a backlight circuit and a display panel;

the backlight circuit provides backlight for the display panel;

the display panel includes:

a timing control circuit configured to read initial data of the display panel;

a power circuit configured to supply power to the display panel;

a gate driver configured to drive a scanning line of the display panel; and a control circuit;

the control circuit includes a first resistor, a second resistor, a third resistor, a fourth resistor, a first field effect transistor, a second field effect transistor and a third field effect transistor;

the timing control circuit is connected to the gate of the second field effect transistor; the power circuit is connected in series with the first resistor and the second resistor, the gate of the first field effect transistor is connected between the first resistor and the second resistor, the drain of the first field effect transistor and the drain of the second field effect transistor are jointly connected to the gate of the third field effect transistor, and the gate of the third field effect transistor is connected in series with the third resistor and grounded; the source of the first field effect transistor, the source of the second field effect transistor and the source of the third field effect transistor are jointly connected to a supply voltage, the drain of the third field effect transistor is connected to the gate driver, and the drain of the third field effect transistor is connected in series with the fourth resistor and grounded.

According to the inventors research, when the display device is just turned on, the timing control circuit needs certain time to read an external code, the power circuit also needs time to output each voltage, and if the backlight is normally turned on during this time, the boot screen is abnormal. Compared with the delay of the backlight turn-on time to ensure a normal boot screen, this application has the advantages that whether the configuration of the timing control circuit and the power circuit has been completed is judged, the gate driver is started if the configuration has been completed to operate normally and drive the display panel to display, and the gate driver may not output if the configuration of one of the timing control chip and the power circuit has not been completed, thereby maintaining, a black screen state to avoid a boot screen abnormality, meanwhile, the design is simple and easy, the cost is low, and the boot time is saved.

DETAILED DESCRIPTION

It should be understood that the terms used herein, specific structures and functional details disclosed herein are merely representative, and are intended to describe specific embodiments. However, this application may be specifically implemented in many alternative forms, and should not be construed as being limited to the embodiments set forth herein.

In the description of this application, the terms such as "first" and "second" are used only for the purpose of description, and should not be understood as indicating the relative importance or implicitly specifying the number of the indicated technical features. Therefore, unless otherwise stated, a feature defined by "first" or "second" can explicitly or implicitly include one or more of said features, and "a plurality of" means two or more than two. The terms "include", "comprise" and any variant thereof are intended to cover non-exclusive inclusion, and do not preclude the presence or addition of one or more other features, integers, steps, operations, elements, components, and/or combinations thereof.

In addition, orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating that the mentioned apparatus or component must have a particular orientation or must be constructed and operated in a particular orientation. Therefore, such terms should not be construed as limiting of this application.

In addition, unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

This application is described below with reference to the accompanying drawings and embodiments.

Figure 1:
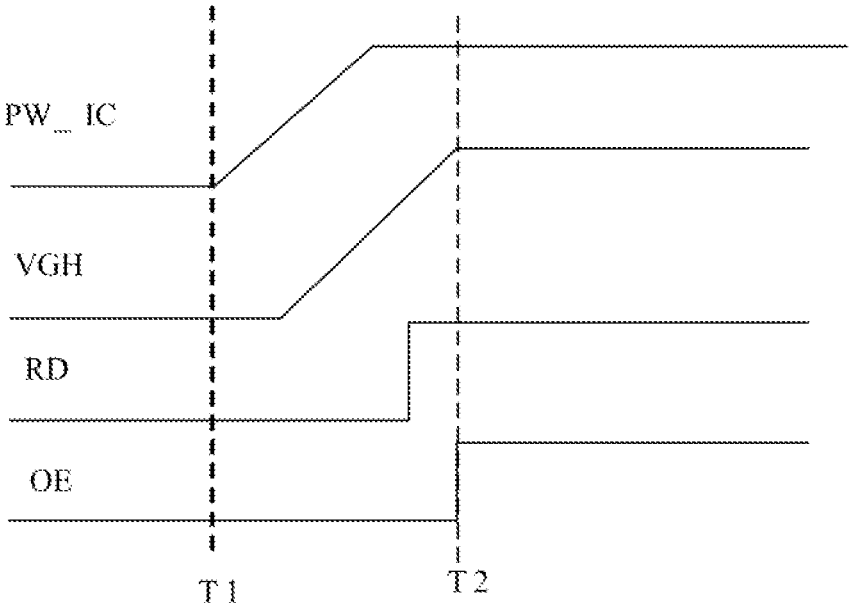
FIG. 1 is a schematic diagram of a signal waveform according to one embodiment of this application.
Figure 2:
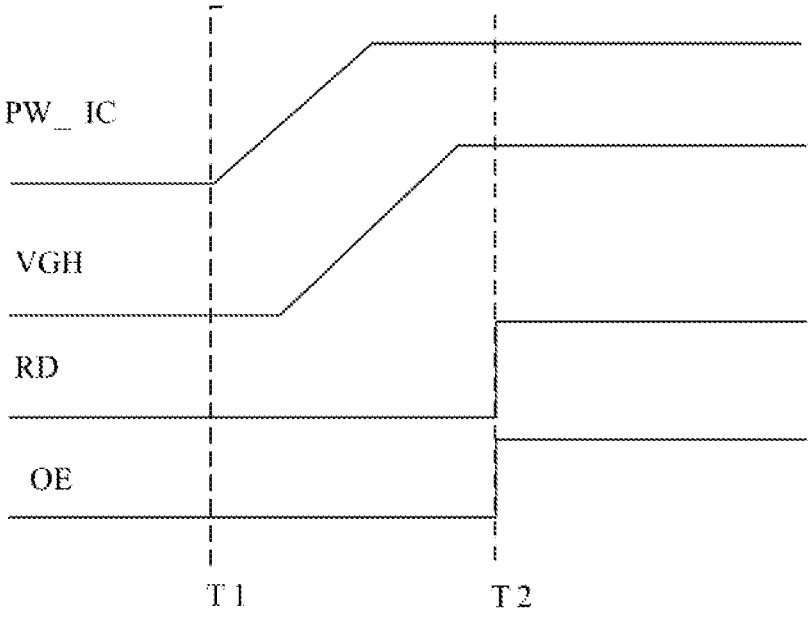
FIG. 2 is a schematic diagram of a signal waveform according to one embodiment of this application.
Figure 3:
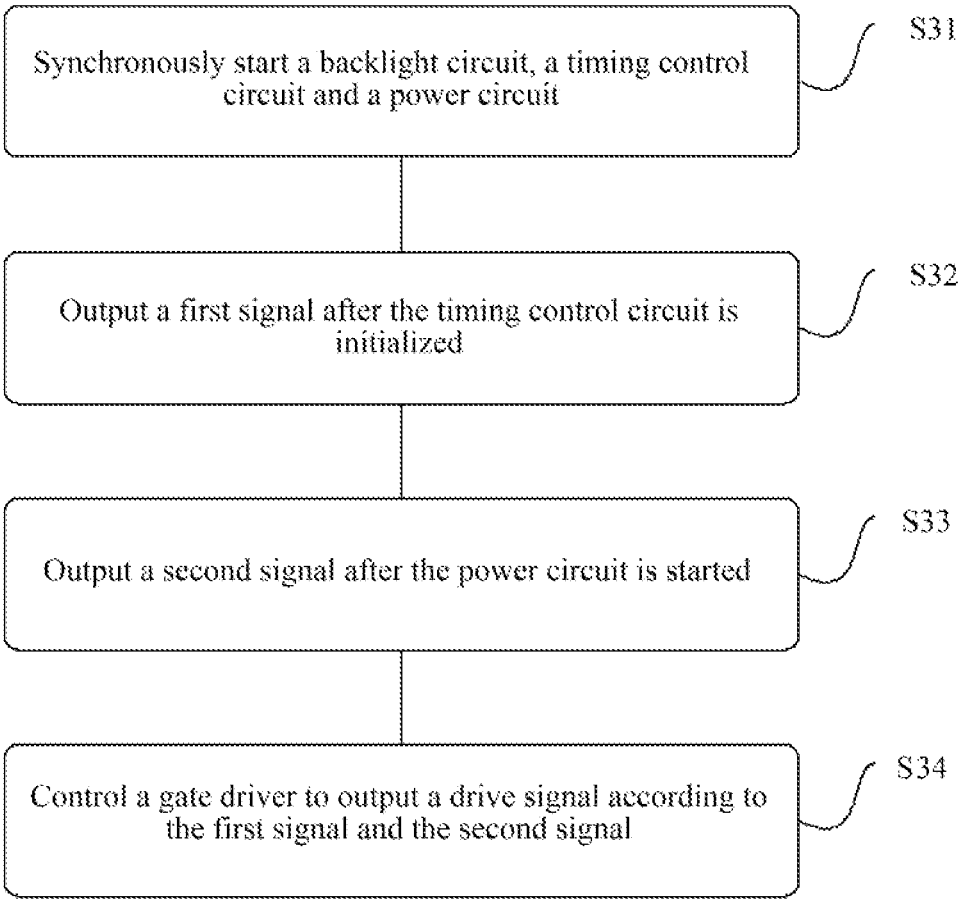
FIG. 3 is a schematic diagram of steps of a driving method according to one embodiment of this application.

As shown in FIG. 1 to FIG. 3, an embodiment of this application discloses a display device driving method, including steps of:

S31: synchronously starting a backlight circuit 200, a timing control circuit 110 and a power circuit 120;

S32: outputting a first signal after the timing control circuit 110 is initialized;

S33: outputting a second signal after the power circuit 120 is started; and S34: controlling a gate driver 140 to output a drive signal according to the first signal and the second signal.

In this solution, as shown in FIG. 1, the first signal is an RD signal, and a high-level RD signal is output after the configuration of the timing controller is completed; the second signal is a PW_IC signal, and a high-level PW_IC signal is output after the configuration of the power circuit is completed; the drive signal is an OE signal, the circuits are synchronously started at the time T1, the gate driver 140 is controlled to output an OE signal when the PW_IC signal changes from a low level to a high level and after the potential of the RD signal rises from a low level to a high level, and the OE signal changes from a low level to a high level at the time T2. Whether the configuration of the timing control circuit 110 and the power circuit 120 has been completed is judged, the gate driver 140 is started if the configuration has been completed to operate normally and drive the display panel to display, and the gate driver 140 may not output if the configuration of one of the timing control chip and the power circuit 120 has not been completed, thereby maintaining a black screen state to avoid a boot screen abnormality, meanwhile, the design is simple and easy, the cost is low, and the boot time is saved.

In one or more embodiments, the second signal includes a starting voltage signal, and the starting voltage signal is output to a scanning line through the gate driver 140; the step of controlling a gate driver 140 to output a drive signal according to the first signal and the second signal includes: controlling a gate driver 140 to output a drive signal according to the first signal and the starting voltage signal.

As shown in FIG. 2, the first signal is an RD signal, the second signal is a VGH signal, the drive signal is an OE signal, the gate driver 140 is controlled to output an OE signal when the RD signal changes from a low level to a high level and after the potential of the VGH signal rises from a low level to a high level, and the OE signal changes from a low level to a high level at this time. Different from FIG. 1, the RD signal in FIG. 2 tends to be stable, whereas the VGH signal in FIG. 1 tends to be stable. The timing control circuit and the power circuit adopt two completely independent chips, so in practical applications, which one is stable first is not determined, especially the complexity of the chip is higher, and the two situations in FIG. 1 and FIG. 2 may occur.

In this solution, the starting voltage signal serves as a starting voltage for displaying of the display device, meanwhile, the voltage of the starting voltage signal is the highest-level voltage that the power circuit 120 outputs to respective units, and the starting voltage signal is also a voltage signal finally generated in the power circuit 120. Accordingly, the starting voltage signal is used as a criterion to judge whether the power circuit 120 has normally output.

In one or more embodiments, the step of controlling a gate driver 140 to output a drive signal according to the first signal and the second signal includes: outputting a power starting signal according to the starting voltage signal; and controlling a gate driver to output a drive signal according to the first signal and the power starting signal;

where the voltage of the power starting signal is lower than that of the starting voltage signal.

In this solution, the voltage of the starting voltage signal is too high to be directly output to the gate circuit 162, so the voltage of the starting voltage signal needs to be bucked to output a power starting signal with lower voltage. When the voltage of the starting voltage signal rises to 30 V, the power starting signal is output, which means that the configuration of the voltage output from the power circuit 120 to each part has been completed. When the power starting signal and the first signal simultaneously satisfy a condition, the gate driver 140 outputs a drive signal.

In one or more embodiments, the step of outputting a power starting signal according to the starting voltage signal includes: outputting a power starting signal when the voltage of the starting voltage signal reaches 30 V.

In this solution, when the starting voltage signal just rises to 30 V, the voltage of the power starting signal rises from a low level to a high level.

In one or more embodiments, the step of controlling a gate driver 140 to output a drive signal according to the first signal and the second signal includes: controlling a gate driver 140 to output a drive signal when the first signal changes from a low level to a high level and the second signal satisfies a condition.

In this solution, when the timing control circuit 110 is just initialized, the output first signal is of a low level; after the timing control circuit 110 completes the initialization, the output first signal is of a high level; and when the second signal is also of a high level, the gate driver 140 is controlled to output a drive signal.

As shown in FIG. 4 to FIG. 9, as another embodiment of this application, a display device is disclosed, including a backlight circuit 200 and a display panel 100; the backlight circuit 200 provides backlight for the display panel 100; the display panel 100 includes: a timing control circuit 110 configured to read initial data of the display panel 100, a power circuit 120 configured to supply power to the display panel 100, a gate driver 140 configured to drive a scanning line of the display panel, and a control circuit 160; the timing control circuit 110 outputs a first signal to the control circuit 160; the power circuit 120 outputs a second signal to the control circuit 160; and the control circuit 160 controls the gate driver 140 to output a drive signal according to the first signal and the second signal.

In this solution, the control circuit 160 judges whether the configuration of the timing control circuit 110 and the power circuit 120 has been completed, the gate driver 140 is started if the configuration has been completed to operate normally and drive the display panel to display, and the gate driver 140 may not output if the configuration of one of the timing control chip and the power circuit 120 has not been completed, thereby maintaining a black screen state to avoid a boot screen abnormality, meanwhile, the design is simple and easy, the cost is low, and the boot time is saved.

In one or more embodiments, the second signal includes a starting voltage signal, the starting voltage signal is output to the gate driver 140, and the control circuit 160 controls the gate driver 140 to output a drive signal according to the first signal and the starting voltage signal.

In this solution, the starting voltage signal serves as a starting voltage for displaying of the display device, meanwhile, the voltage of the starting voltage signal is the highest-level voltage that the power circuit 120 outputs to respective units, and the starting voltage signal is also a voltage signal finally generated in the power circuit 120. Accordingly, the starting voltage signal is used as a criterion to judge whether the power circuit 120 has normally output.

In one or more embodiments, the control circuit 160 includes a detection circuit 161 and a gate circuit 162, where the detection circuit 161 reads a starting voltage signal and outputs a power starting signal; the detection circuit 161 is connected to the power circuit 120 and the gate circuit 162 separately, and the gate circuit 162 is also connected to the timing control chip; the first signal and the power starting signal are output to the gate circuit 162, and the gate circuit 162 controls the gate driver 140 to output a drive signal according to the first signal and the starting voltage signal.

In this solution, the voltage of the starting voltage signal is too high to be directly output to the gate circuit 162, so the detection circuit 161 is used to monitor the voltage of the starting voltage signal in real time. When the voltage of the starting voltage signal rises to 30 V, the detection circuit 161 outputs a power starting signal, which means that the configuration of the voltage output from the power circuit 120 to each part has been completed. The power starting signal and the first signal are output to the gate circuit 162 together, and when the power starting signal and the first signal simultaneously satisfy the condition, the gate circuit 162 controls the gate driver 140 to output a drive signal.

In one or more embodiments, the gate circuit 162 includes an AND gate circuit 163, the detection circuit 161 and the timing control circuit 110 are connected to the input end of the AND gate circuit 163, and the AND gate circuit 163 controls the gate driver 140 to output a drive signal according to the first signal and the starting voltage signal.

In this solution, the AND gate circuit 163 is used to ensure that the AND gate circuit 163 has an output when the first signal and the power starting signal simultaneously satisfy the condition.

As shown in FIG. 6 to FIG. 9, in one or more embodiments, the control circuit 160 includes a buck circuit 150 configured to buck an input signal, and a switch circuit 130; the switch circuit 130 includes a first input end 1301 and a second input end 1302; the timing control circuit 110 is connected to the first input end 1301 of the switch circuit 130, the power circuit 120 is connected to the second input end 1302 of the switch circuit 130 through the buck circuit 150, and the output end of the switch circuit 130 is connected to the gate driver 140.

In this solution, a ready signal is output to the switch circuit 130 after the configuration of the timing control circuit 110 is completed, the starting voltage signal (VGH signal) of the power circuit 120 is bucked by the buck circuit 150 and then output to the switch circuit 130, and when the ready signal and the starting voltage signal are simultaneously at a high level, the switch circuit 130 outputs a high level to control the output of the gate driver 140; the gate driver 140 may not output if the configuration of one of the timing control chip and the power circuit 120 has not been completed, thereby maintaining a black screen state to avoid a boot screen abnormality, meanwhile, the design is simple and easy, the cost is low, and the boot time is saved.

In one or more embodiments, the switch circuit 130 includes: a first judgment circuit 131 configured to output a first logic signal according to the signal input by the timing control circuit 110; a second judgment circuit 132 configured to output a second logic signal according to the signal input by the buck circuit 150; and a third judgment circuit 133 configured to output a third logic signal according to the first logic signal and the second logic signal. The input end of the first judgment circuit 131 is connected to the timing control circuit 110, the input end of the second judgment circuit 132 is connected to the buck circuit 150, the output ends of the first judgment circuit 131 and the second judgment circuit 132 are connected to the input end of the third judgment circuit 133, and the output end of the third judgment circuit 133 is connected to the gate driver 140.

In this solution, the first judgment circuit 131 is configured to judge the ready signal output by the timing control circuit 110, and output a first logic signal when the ready signal rises from a low level to a high level; the second judgment circuit 132 is configured to judge the VGH signal output by the buck circuit 150, and output a second logic signal when the VGH signal rises from a low level to a high level; and when the first logic signal and the second logic signal are at the high level, the third judgment circuit 133 outputs a high level to control the output of the gate driver 140.

In one or more embodiments, the buck circuit 150 includes a first resistor and a second resistor, the first resistor is connected in series with the second resistor, the first end of the first resistor is connected to the power circuit 120, the second end of the first resistor is connected to the first end of the second resistor, the second end of the second resistor is grounded, and the second input end of the switch circuit 130 is connected between the first resistor and the second resistor.

In this solution, the buck circuit 150 consists of two series resistors, bucks the high-voltage starting voltage signal to a low-voltage power starting signal by using the principle of voltage division of the series resistors, and outputs the power starting signal to the second judgment circuit 132, thereby preventing circuit damage caused by too high voltage of the starting voltage signal directly output to the second judgment circuit 132.

In one or more embodiments, the resistance of the first resistor is greater than that of the second resistor. In this solution, the starting voltage signal can be up to 30 V, the second judgment circuit 132 only needs 3.7 V, generally not more than 5 V, and the voltage obtained by division is more if the resistance is larger according to the principle of voltage division of the series resistors, so when the resistance of the first resistor is greater than that of the second resistor, the power starting signal can be normally output to the second judgment circuit 132 without damaging the circuit.

In one or more embodiments, the first judgment circuit 131 includes a first active switch 1311, the input end of the first active switch 1311 is connected to the timing control circuit 110, and the output end of the first active switch 1311 is connected to the second judgment circuit 132.

In one or more embodiments, the second judgment circuit 132 includes a second active switch 1321, the input end of the second active switch 1321 is connected to the buck circuit 150, and the output end of the second active switch 1321 is connected to the second judgment circuit 132.

In one or more embodiments, the third judgment circuit 133 includes a third active switch 1331, the input end of the third active switch 1331 is connected to the first judgment circuit 131 and the second judgment circuit 132 separately, and the output end of the third active switch 1331 is connected to the gate driver 140.

In this solution, the first active switch 1311 is a P-type field effect transistor (PMOS P1), the second active switch 1321 is a PMOS P3, and the third active switch 1331 is a PMOS P3. As shown in FIG. 1, the voltage level at the upper end of R2 is named V1, V1 controls the gate of PMOS P1, and the ready signal output by the timing control circuit 110 acts as a gate control signal of PMOS P2. When the voltage level of the VGH signal is still low during boost, the V1 voltage level is also low. The turn-on voltage VGS of PMOS is less than 0, so P1 is turned on. VDD is a logic voltage of the system, and VDD at this time is connected to R3 through P1. The voltage level at the upper end of R3 is named V2. At this time, V2=VDD, then for PMOS P3, VGS=0, so P3 may not be turned on, the OE signal can only be connected to the ground by R4, the OE signal outputs a low level, and the gate driver 140 may not be started to output. Similarly, when the ready signal of the timing control circuit 110 is of a low level. PMOS P2 can also be turned on, VDD can also be connected to R3 by PMOS P2, and V2=VDD, so PMOS P3 can also be controlled to be turned off. It can be seen that as long as any one of PMOS P1 and PMOS P2 is turned on, V2 is equal to VDD, PMOS P3 is turned off, and the output OE signal is of a low level, that is, if any one of the VGH signal and the ready signal is of a low level, the OE signal is of a low level.

That is to say, only when the voltage level of the VGH signal is sufficient, V1 is a high level, the VGS of PMOS P1 is equal to 0, PMOS P1 is turned off, meanwhile, the ready signal of the timing control circuit 110 is of a high level, PMOS P2 is also turned off, at this time, V2 is connected to the ground through R3, V2=0, then the VGS of PMOS P3 is less than 0, P3 is turned on, VDD is connected to R4 through PMOS P3, and the OE signal is of a high level, which is realized as shown in FIG. 3. Only when the VGH signal and the ready signal are operating normally, the OE signal is of a high level, and the gate driver 140 is started to output normally.

In one or more embodiments, the first judgment circuit 131 includes a first gate circuit 1312, the second judgment circuit 132 includes a second gate circuit 1322, and the third judgment circuit 133 includes a third gate circuit 1332.

Figure 4:
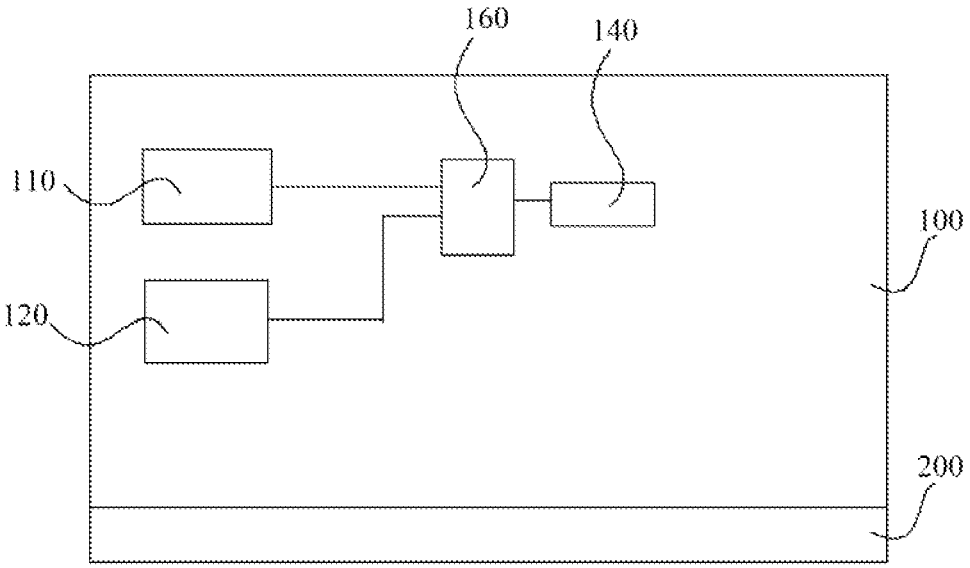
FIG. 4 is a schematic diagram of a display device according to one embodiment of this application.

In this solution, as shown in FIG. 4, the first gate circuit is a first NOT gate circuit 1313, the second gate circuit is a second NOT gate circuit 1323, and the third gate circuit is a NOR gate circuit 1333. Only when the voltage level of the VGH signal is a high level, the first NOT gate circuit 1313 outputs a low level. Meanwhile, when the voltage level of the ready signal is a high level and the second NOT gate circuit 1323 outputs a low level, the NOR gate circuit 1333 outputs a high level. In this solution, the switch circuit 130 may be an AND gate circuit, and only when the voltage level of the VGH signal is a high level and the voltage level of the ready signal is a high level, the AND gate circuit outputs a high level.

Figure 5:
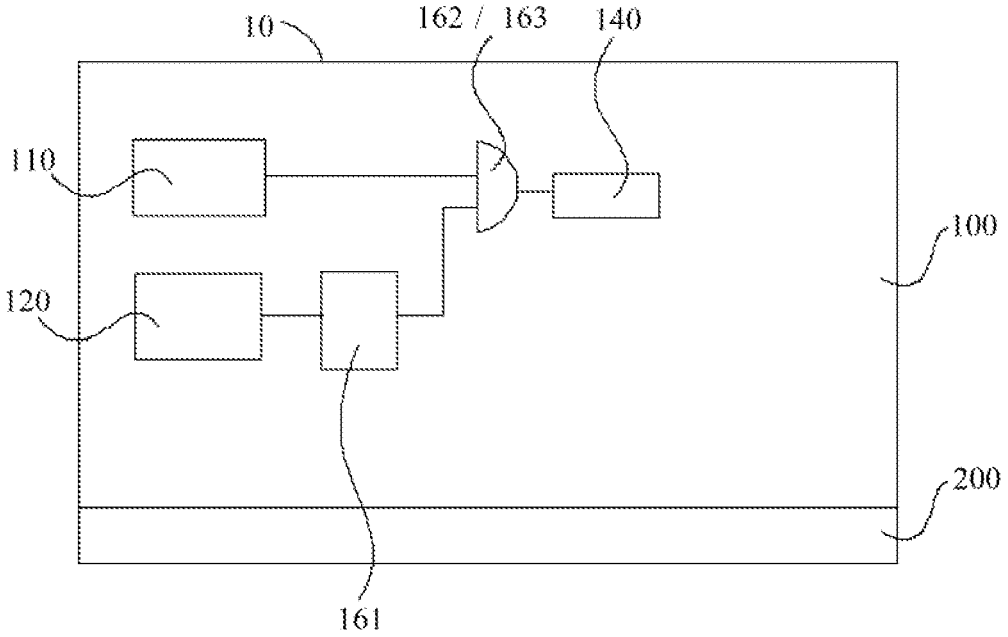
FIG. 5 is a schematic diagram of a display device according to one embodiment of this application.

As shown in FIG. 5, as another embodiment of this application, a display device is disclosed, including a backlight circuit and a display panel; the backlight circuit 200 provides backlight for the display panel 100; the display panel 100 includes: a timing control circuit 110 configured to reading initial data of the display panel, a power circuit 120 configured to supply power to the display panel 100, a gate driver 140 configured to drive a scanning line of the display panel, a detection circuit 161 and a gate circuit 162; the detection circuit 161 reads a starting voltage signal and outputs a power starting signal; the timing control circuit 110 outputs a first signal to the gate circuit; the power circuit 120 outputs a starting voltage signal to the detection circuit 161, and the detection circuit 161 outputs the power starting signal to the gate circuit; and the gate circuit controls the gate driver 140 to output a drive signal according to the first signal and the power starting signal.

In this solution, the control circuit judges whether the configuration of the timing control circuit 110 and the power circuit 120 has been completed, the gate driver 140 is started if the configuration has been completed to operate normally and drive the display panel to display; and the gate driver 140 may not output if the configuration of one of the timing control Chip and the power circuit 120 has not been completed, thereby maintaining a black screen state to avoid a boot screen abnormality, meanwhile, the design is simple and easy, the cost is low, and the boot time is saved.

Figure 6:
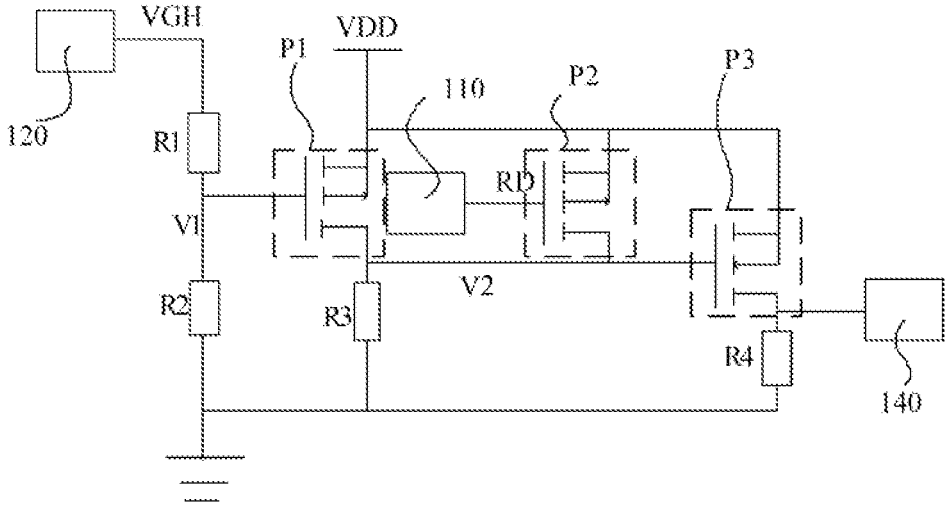
FIG. 6 is a schematic diagram of a display device drive circuit according to one embodiment of this application.
Figure 7:
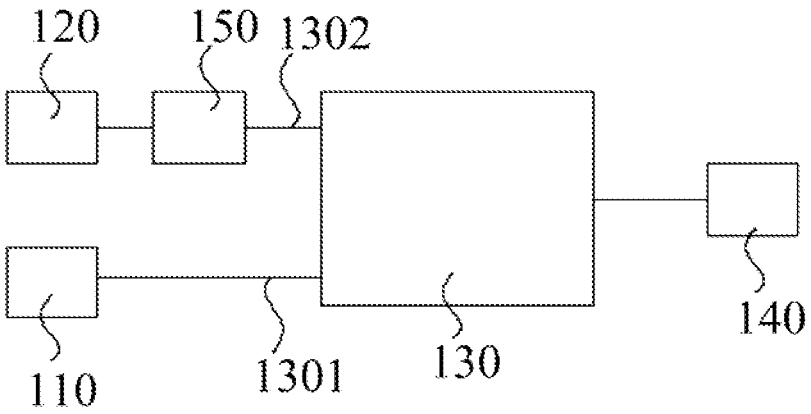
FIG. 7 is a schematic diagram of a display device drive circuit according to one embodiment of this application.
Figure 8:
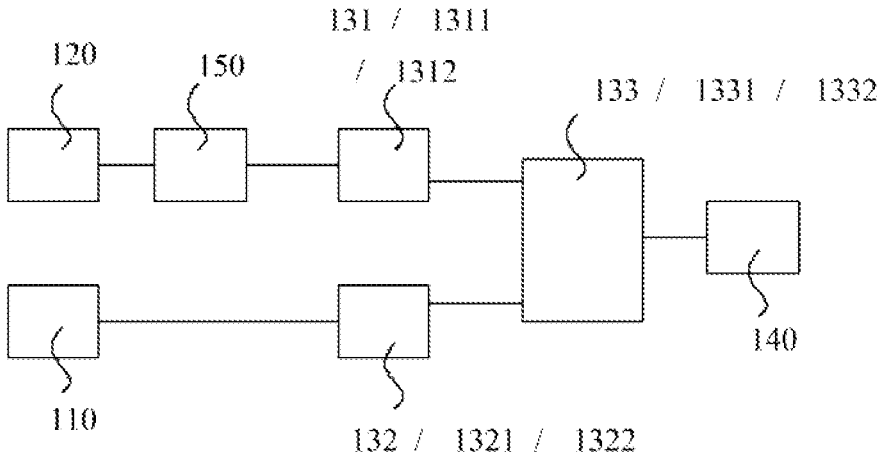
FIG. 8 is a schematic diagram of a display device drive circuit according to one embodiment of this application.
Figure 9:
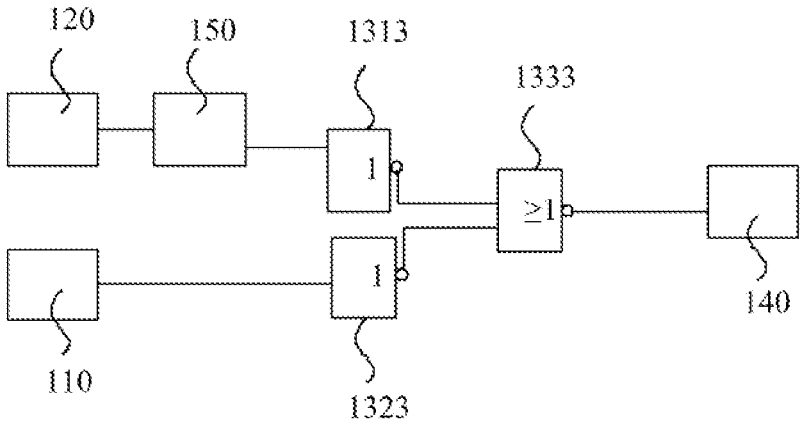
FIG. 9 is a schematic diagram of a display device drive circuit according to one embodiment of this application.

As shown in FIG. 6, as another embodiment of this application, a drive circuit of a display panel is disclosed, including: a timing control circuit 110 configured to read initial data of the display panel, a power circuit 120 configured to supply power to the display panel, a gate driver 140 configured to drive a scanning line of the display panel, a first resistor R1, a second resistor R2, a third resistor R3, a fourth resistor R4, a first field effect transistor P1, a second field effect transistor P2 and a third field effect transistor P3; the timing control circuit 110 is connected to the gate of the second field effect transistor P2; the power circuit 120 is connected in series with the first resistor R1 and the second resistor R2 and grounded, the gate of the first field effect transistor P1 is connected between the first resistor R1 and the second resistor R2, the drain of the first field effect transistor P1 and the drain of the second field effect transistor P2 are jointly connected to the gate of the third field effect transistor P3, and the gate of the third field effect transistor P3 is connected in series with the third resistor R3 and grounded; the source of the first field effect transistor P1, the source of the second field effect transistor P2 and the source of the third field effect transistor P3 are jointly connected to a supply voltage, the drain of the third field effect transistor P3 is connected to the gate driver 140, and the drain of the third field effect transistor is connected in series with the fourth resistor R4 and grounded.

In this solution, whether the configuration of the timing control circuit 110 and the power circuit 120 has been completed is judged, the gate driver 140 is started if the configuration has been completed to operate normally and drive the display panel to display, and the gate driver 140 may not output if the configuration of one of the timing control chip and the power circuit 120 has not been completed, thereby maintaining a black screen state to avoid a boot screen abnormality, meanwhile, the design is simple and easy, the cost is low, and the boot time is saved. As shown in FIG. 1, only when the voltage level of the VGH signal is sufficient, V1 is a high level, the VGS of PMOS P1 is equal to 0, PMOS P1 is tinned off meanwhile, the RD signal of the timing control circuit 110 is of a high level, PMOS P2 is also turned off, at this time, V2 is connected to the ground through R3, V2=0, then the VGS of PMOS P3 is less than 0, P3 is turned on, VDD is connected to R4 through PMOS P3, and meanwhile the OE signal is of a high level, which is realized as shown in FIG. 3. Only when the VGH signal and the RD signal are operating normally, the OE signal is of a high level, and the gate driver 140 is started to output normally.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

The technical solutions of this application can be widely applied to various display panels, such as twisted nematic (TN) panels, in-plane switching (IPS) panels, and multi-domain vertical aliment (VA) panels. Certainly, other suitable types of display panels such as organic light-emitting diode (OLED) display panels are also applicable to the above solutions.

The foregoing content is merely detailed descriptions of this application made with reference to specific implementations, and should not be considered limiting of specific implementations of this application. Persons of ordinary skill in the art can make simple deductions or replacements without departing from the concept of this application, and such deductions or replacements should all be considered as falling within the protection scope of this application.

What is claimed is:

1. A display device driving method, comprising steps of:

synchronously starting a backlight circuit, a timing control circuit and a power circuit;

outputting a first signal after the timing control circuit is initialized;

outputting a second signal after the power circuit is started; and controlling a gate driver to output a drive signal according to the first signal and the second signal;

wherein the second signal comprises a starting voltage signal, and the starting voltage signal is output to a scanning line through the gate driver;

the step of controlling a gate driver to output a drive signal according to the first signal and the second signal comprises: controlling a gate driver to output a drive signal according to the first signal and the starting voltage signal;

wherein the step of controlling a gate driver to output a drive signal according to the first signal and the starting voltage signal comprises:

outputting a power starting signal according to the starting voltage signal; and controlling a gate driver to output a drive signal according to the first signal and the power starting signal;

wherein the voltage of the power starting signal is lower than that of the starting voltage signal.

2. The display device driving method according to claim 1, wherein the step of outputting a power starting signal according to the starting voltage signal comprises: outputting a power starting signal when the voltage of the starting voltage signal reaches 30 V.

3. The display device driving method according to claim 2, wherein the step of outputting a power starting signal according to the starting voltage signal comprises: bucking the starting voltage signal by a buck circuit and then output the power starting signal.

* * * * *